United States Patent [19]

Brannlund

[11] Patent Number: 4,579,552

[45] Date of Patent: Apr. 1, 1986

[54] SHEET ROCK TAPE CRIMPING DEVICE

[76] Inventor: Paul Brannlund, RFD 2, Box 646, Excelsior Springs, Mo. 64024

[21] Appl. No.: 659,446

[22] Filed: Oct. 9, 1984

[51] Int. Cl.[4] ..... B65H 45/09

[52] U.S. Cl. ..... 493/439

[58] Field of Search ..... 493/116, 382, 424, 439, 493/443, 454, 455; 72/176

[56] References Cited

U.S. PATENT DOCUMENTS

| | | | |
|---|---|---|---|
| 2,400,698 | 5/1946 | Lissa | 493/439 |
| 2,592,766 | 4/1952 | Tincher | 493/455 |
| 2,676,797 | 4/1954 | Mills | 493/455 |
| 2,956,799 | 10/1960 | Wasson | 493/439 |
| 3,147,009 | 9/1964 | Gram | 493/439 |
| 3,326,738 | 6/1967 | McLaughlin | 493/439 |
| 3,605,472 | 9/1971 | Saito et al. | 72/176 |
| 4,395,255 | 7/1983 | Branecky et al. | 493/439 |

*Primary Examiner*—Francis S. Husar
*Assistant Examiner*—William E. Terrell

[57] ABSTRACT

This device is designed to be employed for those installing sheet rock panels, because it effectively creases the sheet rock tape, for placement in the corners of installed sheet rock panels. Primarily, it consists of a triangular bottom member capped by a channel member, in which is mounted a pair of forming rollers, for crimping the tape to conform to a corner.

2 Claims, 7 Drawing Figures

10
11
11 M.B.
12
13
14
15
16
17
18
19
20
21
22
23
24
25
26
27
28
6

SHEET ROCK TAPE CRIMPING DEVICE

This invention relates to shaping devices for materials, and more particularly, to a sheet rock tape crimping device.

The principal object of this invention is to provide a sheet rock tape crimping device, which will be of such design, as to be employed to shape rock tape quickly and effectively into a properly folded condition for application to joined sheets of sheet rock in corners, thus saving the installers a great deal of time.

Another object of this invention is to provide a sheet rock tape crimping device, which will be of such design, as to include a pair of spaced rollers, which will be mounted in a guide portion of the assembly, for forming a semi-bead along the longitudinal center of the tape, as the tape is fed through the device.

A further object of this invention is to provide a sheet rock tape crimping device, which will be manually operated and safe to use.

Other objects are to provide a sheet rock tape crimping device, which is simple in design, inexpensive to manufacture, rugged in construction, easy to use, and efficient in operation.

These, and other objects, will be readily evident, upon a study of the following specification, and the accompanying drawing, wherein.

Figures 1, 2, 3, 4, 5, 6, 7:
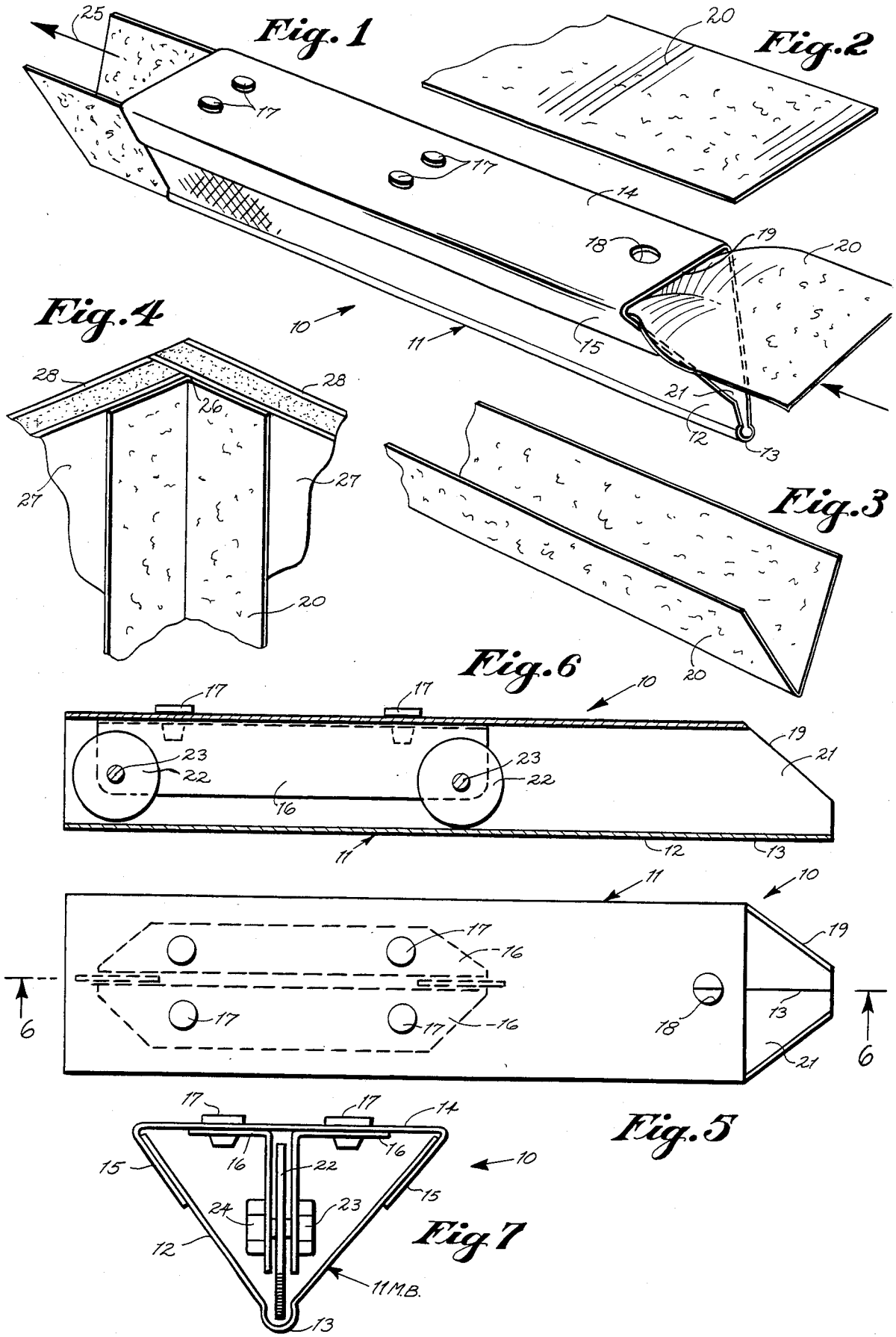
FIG. 1 is a perspective view of the present invention, shown in operative use.
FIG. 2 is a fragmentary perspective view of the tape, shown prior to being crimped.
FIG. 3 is similar to FIG. 2, showing the tape after being crimped.
FIG. 4 is a perspective view, showing the crimped tape after being removed from the device.
FIG. 5 is a top plan view of the device, showing the tape removed therefrom.
FIG. 6 is a cross-sectional view, taken along the line 6—6 of FIG. 5.
FIG. 7 is an enlarged end elevational view of the invention.

Accordingly, a device 10 is shown to include a substantially triangular-shaped main body 11, consisting of a "V"-shaped member 12, having a bead formed portion at its apex 13. A channel member 14 is provided, and its sides 15 are force fitted onto the upper ends of member 12, or are fixedly secured thereto, in a suitable manner, if desired.

A pair of spaced mounting brackets 16, of inverted "L"-shape, are fixedly secured to the inside surface of the top of channel member 14, by suitable fasteners 17, and brackets 16 are disposed towards the rear of the interior of device 10, and are spaced from an observation opening 18 through channel member 14. The forward or front end 19 of device 10 is cut at an angle, for easy and smooth feeding of the tape 20 into the opening 21 defined in the device 10, and a pair of spaced forming rollers 22 are freely and rotatably received on bolts 23 received through the end portions of brackets 16. A nut fastener 24 is received on the bolt fasteners 23, and rollers 22 are also freely received between brackets 16, and spaced from the apex 13 for crimping tape 20, as illustrated in FIGS. 3 and 4. The direction of feed of tape 20 through device 10 is indicated by the arrow 25.

In operation, the tape 20, to be crimped, is precreased by the user at its leading edge center, prior to its being introduced into the opening 21 at the forward end 19 of device 10. The device 10 is then held in the user's hand, and tape 20 is force fed in the direction of the arrow 25, until it starts to appear at the rear of device 10. When the above occurs, the user then pulls the tape 20 through device 10, and, as the tape 20 traverses the interior of device 10, the rollers 22 rotate, and being in engagement with the center of the tape 20, rollers 22 force the longitudinal center of the tape 20 into the beaded apex 13 thereof, thus crimping or forming tape 20 into a "V"-shape, for application to the corner 26 formed by the sheet rock panels 27 on the walls 28.

While various changes may be made in the details of construction, it is understood that such changes will be within the spirit and scope of the present invention, as is defined by the appended claims.

What I claim is:

1. A sheet rock tape crimping device, comprising, in combination, a bottom member, a channel member received on said bottom member, a pair of brackets received in said channel member, and a pair of rollers received in said channel member; and wherein said bottom member is triangular in configuration, and includes a beaded apex portion for forming a fold in said sheet rock tape.

2. The combination as set forth in claim 1, wherein said channel number includes an aperture in the forward end thereof, for observation of said sheet rock tape as it is being entered into said device.

* * * * *

UNITED STATES PATENT AND TRADEMARK OFFICE

CERTIFICATE OF CORRECTION

PATENT NO. : 4,579,552

DATED : April 1, 1986

INVENTOR(S) : Paul Brannlund

It is certified that error appears in the above-identified patent and that said Letters Patent are hereby corrected as shown below:

In the title, change "SHEET ROCK" to read -- GYPSUM DRYWALL

In the Abstract, in each of the 2nd, 3rd and 4th lines, change the terms "SHEET ROCK" to read -- drywall --.

In the specification, col. 1 firstly in the title line 1 change "SHEET ROCK" to read "GYPSUM DRYWALL"; then in each of lines 5, 8, 11, 13-14, 20-21, and 23 change "sheet rock" to read -- drywall --; and finally in line 9, delete the word "Rock" appearing before the word "tape".

In Claim 1, in the first and last lines thereof change the terms "sheet rock" to read -- drywall --.

In Claim 2, in the 3rd line, change "sheet rock" to read -- drywall --.

Signed and Sealed this

Eleventh Day of November, 1986

*Attest:*

DONALD J. QUIGG

*Attesting Officer* *Commissioner of Patents and Trademarks*